US005816464A

United States Patent [19]

Seiler

[11] Patent Number: 5,816,464

[45] Date of Patent: Oct. 6, 1998

[54] CONVERTIBLE PROTECTIVE COVER FOR CAMERAS BINOCULAR AND THE LIKE

[76] Inventor: Douglas A. Seiler, 127 Iolanthus Ave., Novato, Calif. 94945

[21] Appl. No.: 829,319

[22] Filed: Mar. 27, 1997

[51] Int. Cl.[6] ..... A45F 3/02

[52] U.S. Cl. ..... 224/615; 224/257; 224/623; 150/154

[58] Field of Search ..... 224/220, 222, 224/257, 603, 604, 605, 607, 615, 623, 656, 908, 909; 150/154

[56] References Cited

U.S. PATENT DOCUMENTS

| | | |
|---|---|---|
| 2,172,348 | 9/1939 | Githens et al. . |
| 4,162,696 | 7/1979 | Sprung . |
| 4,232,808 | 11/1980 | Gray . |
| 4,339,062 | 7/1982 | Witt, Jr. . |
| 4,649,973 | 3/1987 | Uchin . |
| 4,953,695 | 9/1990 | Tallman . |
| 5,014,846 | 5/1991 | Walker et al. . |
| 5,102,216 | 4/1992 | Mitchell . |
| 5,151,778 | 9/1992 | Conley . |
| 5,366,072 | 11/1994 | Goldenberg . |
| 5,593,024 | 1/1997 | Seiler . |

*Primary Examiner*—David J. Walczak
*Assistant Examiner*—Timothy L. Maust
*Attorney, Agent, or Firm*—Foley & Lardner

[57] ABSTRACT

A convertible protective case for instruments such as binoculars, cameras and the like is comprises a flexible pouch slidingly received on a strap secured to the instrument. The pouch has a lower central opening for insertion and removal of the instrument, and side apertures through which the strap passes. The case is made of a single piece and ply of fabric or composite material folded and joined to define the pouch. Positive closure elements are provided adjacent to the central opening. A biasing fold is formed between an upper fold and the central opening to urge the pouch into a folded or stored configuration wherein it serves as a strap pad worn behind a user's neck. For conversion into its protective configuration, the pouch is unfolded, slid toward the instrument and inverted over the instrument. The closure elements are placed in mutually facing relation both in the folded and stored configuration and in the opened, protective configuration.

18 Claims, 3 Drawing Sheets

FIG. 1
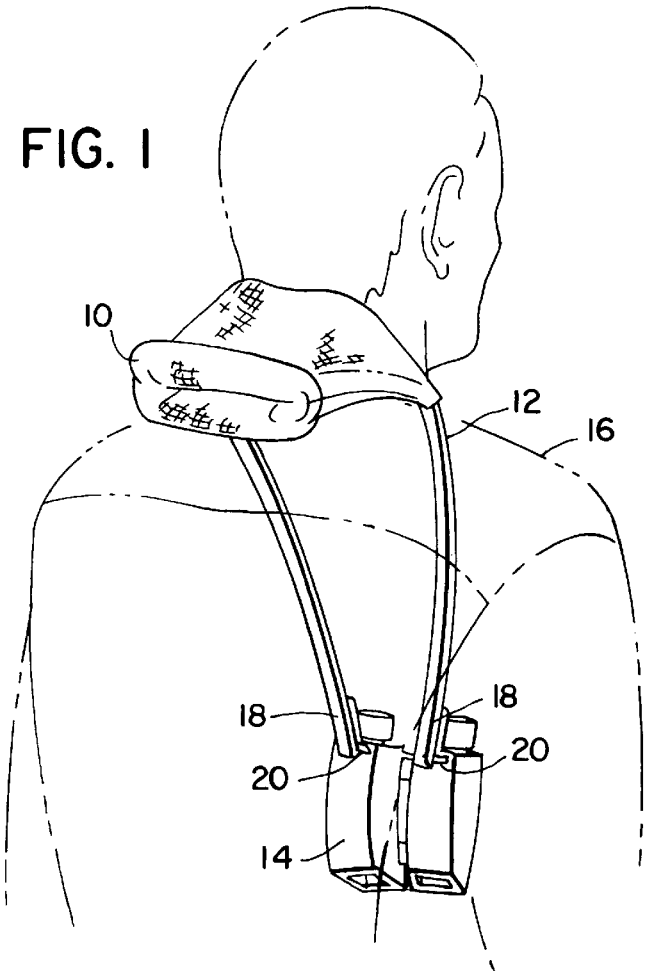
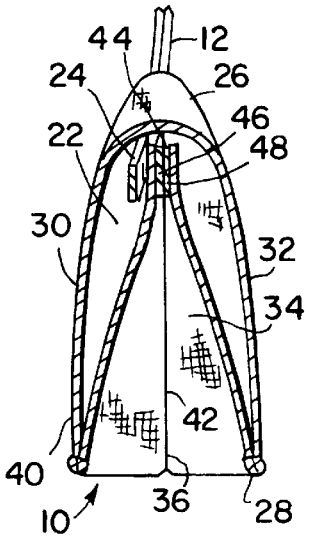
FIG. 3
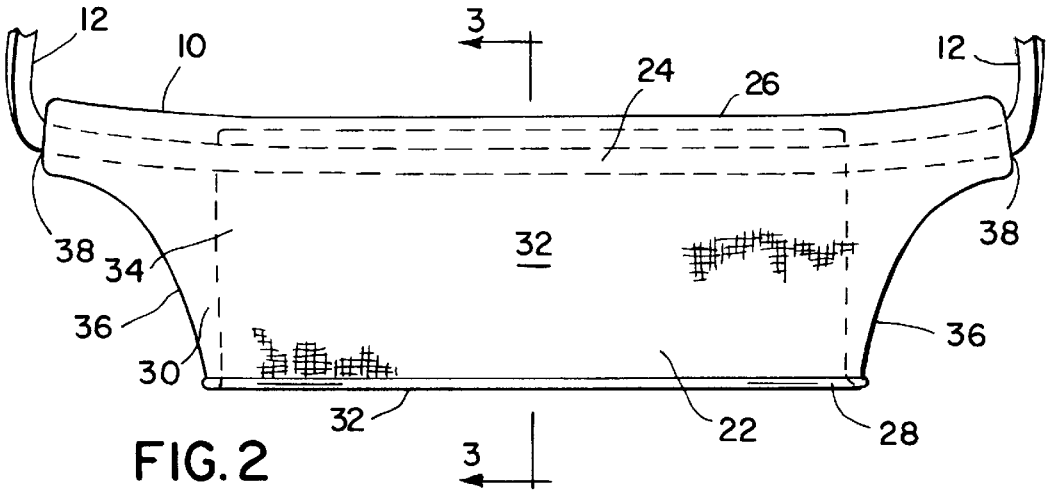
FIG. 2

FIG. 4
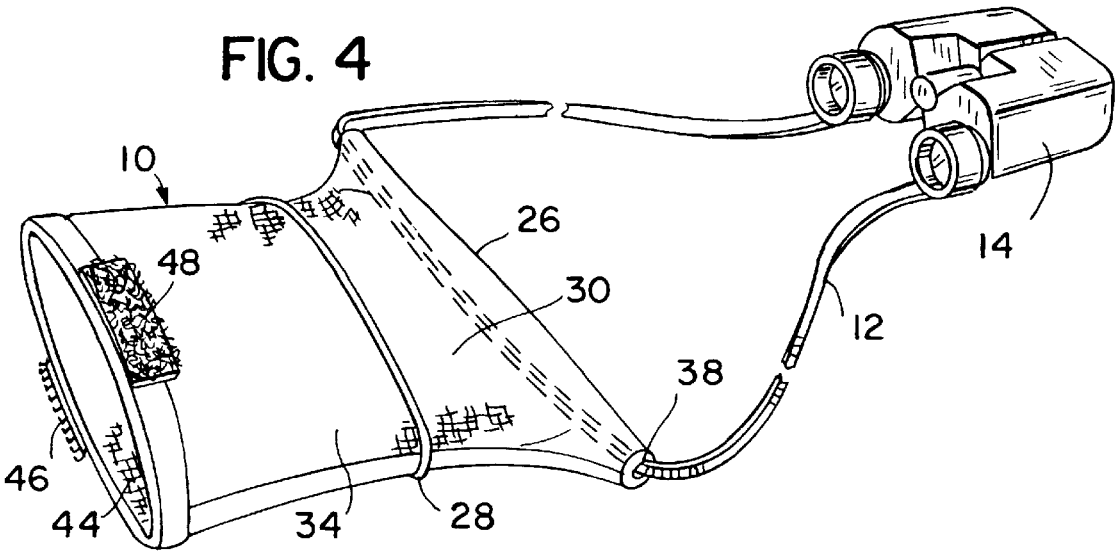
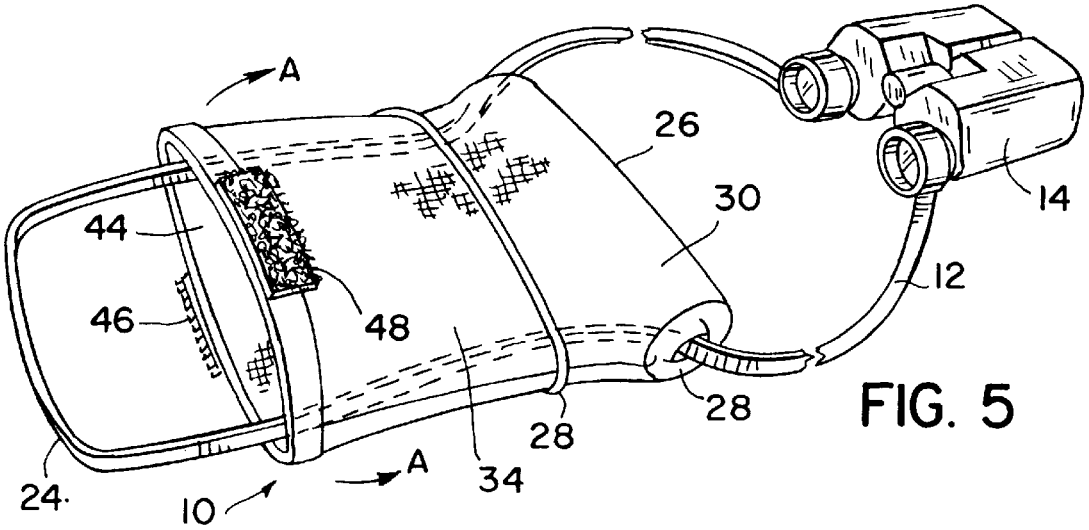
FIG. 5
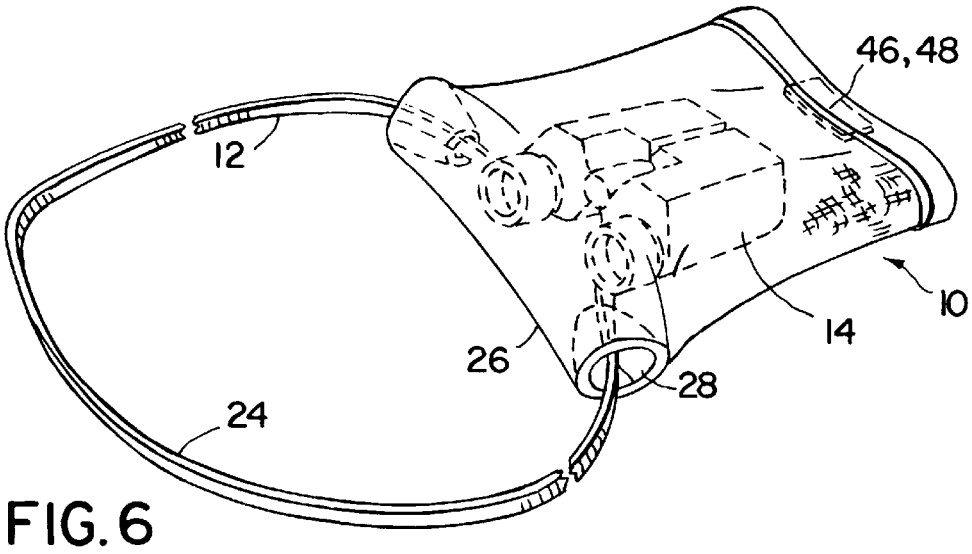
FIG. 6

CONVERTIBLE PROTECTIVE COVER FOR CAMERAS BINOCULAR AND THE LIKE

FIELD OF THE INVENTION

The present invention relates generally to the field of protective cases and covers for objects carried about the neck or shoulder of a user. More particularly, the invention relates to a flexible or soft protective case for covering and protecting delicate instruments, such as cameras, binoculars and the like, connected to a flexible strap or webbing for convenient transport. The case permits the use to easily remove the instrument from the case when desired without separating the case from the strap.

BACKGROUND OF THE INVENTION

Various relatively delicate instruments, such as cameras and binoculars are commonly carried about the neck or shoulder of a user via a strap or webbing, both for convenient transport and to avoid being dropped or inadvertently lost. It is generally known to provide protective cases and covers for such instruments to prevent damage to the instruments when not in use. Such covers typically partially or fully cover the instrument, particularly sensitive elements such as lenses. Portions of the cases are often removable from the instrument to permit its use and may be replaced over the instrument following use. Certain known cases of this type are may permanently or semi-permanently secured to the instrument, such as by snaps or the like, and simply dangle from the instrument when the instrument is in use. Other known cases are fully removed from the instrument when in use.

Heretofore known cases and covers of the type described above often prove inconvenient for several reasons. For example, cases that are attached to the instrument or to a strap secured to the instrument, are often cumbersome when removed from the instrument, and may even inhibit the use of the instrument, such as by entering into the instruments field of sight. Unless the instrument is replaced in the cover following each use, the user will typically hold the instrument suspended about his neck with the case hanging from it. As a result, where possible the user may opt to remove the case from the instrument or from its supporting strap to provide more ready access to the instrument and to reduce the unwieldy combination of the instrument and the case. Once removed, the case is much more susceptible to being lost or forgotten. The latter risk is always present for cases designed to be completely removed from the instrument and strap when the instrument is in use.

Certain alternative case designs have been proposed in attempts to address these inconveniences. In one known design, a soft cover or bag is sewn to an instrument support strap at points adjacent to the ends of the strap where it attaches to the instrument. The bag may be pulled from the instrument for access, but remains adjacent to the instrument at all times. While this arrangement clearly reduces the risk of loss of the cover, it nevertheless encumbers the user in certain operations, such as loading a camera.

There is a need, therefore, for an improved case for delicate instruments of the type transported and supported about the user's neck or shoulder. In particular, there is a need for such an improved case that provides excellent protection for the instrument when stored therein, while not obstructing the use of the instrument when removed therefrom.

SUMMARY OF THE INVENTION

The present invention features a novel case designed to respond to these needs. The case is preferably made of a soft, flexible material, such as fabric or a composite sheet material, and forms a pocket into which the instrument may be selectively placed when not in use. The case is conveniently slid onto the strap or webbing supporting the instrument for installation, and remains slidably secured to the strap thereafter. When the instrument is removed from the case for use, the case may be slid along the strap and positioned behind the user's neck or over the user's shoulder, providing padding for the strap. In a particularly preferred configuration, the case may be folded in a storage position when not covering the instrument, thereby reducing the bulk of the case and providing a platform for printing, logos, lettering or the like.

Thus, in accordance with a first aspect of the invention, a case is provided for an instrument coupled to a support strap. The support strap is of the type having first and second ends, each end being secured to the instrument whereby the instrument may be transported and suspended on the strap. The case comprises a first panel having a first upper and lower edges and first left and right side edges, and a second panel having second upper and lower edges and second left and right side edges. The first upper edge is joined to the second upper edge and the first lower edge is partially joined to the second lower edge to form a pouch having an opening for receiving the instrument. The first left side edge is partially joined to the second left side edge and the first right side edge is partially joined to the second right side edge to form right and left apertures. The left and right apertures are configured to receive the strap, whereby the case is slidably supportable on the strap.

In accordance with another aspect of the invention, an invertible cover is provided for an object supported around a user's neck via a suspension strap. The cover includes a flexible pouch and positive closure means. The pouch has a central opening for receiving the object, and first and second side apertures permitting passage of the strap therethrough. The pouch may thus be slidingly received on the strap. The pouch is configured for use in a first operational configuration wherein the opening is positioned adjacent to the object, and a second operational configuration wherein the pouch is inverted from the first operational configuration and slidably positioned along a central region of the strap. The closure means is disposed on the pouch adjacent to the opening, and is operative in both the first and second operational configurations of the case.

In accordance with still another aspect of the invention, a protective support and cover system for an instrument. The system includes a support strap, a flexible pouch and positive closure means. The support strap has first and second ends and a central region extending therebetween. The first and second ends are configured for coupling to the instrument. The flexible pouch has a central opening for receiving the instrument and first and second side apertures. The strap extends through the first and second side apertures whereby the pouch is slidingly received on the strap. The pouch is configured for use in a first operational configuration wherein the opening is positioned adjacent to the instrument, and a second operational configuration wherein the pouch is inverted from the first operational configuration and slidably positioned along the central region of the strap. The closure means is disposed on the pouch adjacent to the opening and provides for closure of the pouch opening in both operational configurations of the pouch.

BRIEF DESCRIPTION OF THE DRAWINGS

These and other features of the invention will be more readily appreciated by those skilled in the art by virtue of the following detailed description wherein reference is made to the appended Figures. In the Figures, like reference numerals refer to like elements of the preferred embodiments. The following Figures are provided for explanatory purposes:

FIG. 1 is a perspective view of a flexible case slidably attached to a strap supporting a pair of binoculars around a user's neck;

FIG. 2 is a front elevational view of the case of FIG. 1 shown in its folded position;

FIG. 3 is a sectional view along line 3—3 of FIG. 2 illustrating a preferred construction of the case;

FIG. 4 is a perspective view of the case of FIG. 1 unfolded as a first step in conversion of the case from the folded configuration shown in FIG. 1;

FIG. 5 is a perspective view of the case illustrating the manner in which the support strap is extracted from the case prior to inversion of the case over a pair of binoculars;

FIG. 6 is a perspective view of the case following its inversion over the pair of binoculars.

DETAILED DESCRIPTION OF PREFERRED EMBODIMENTS

Figure 7:
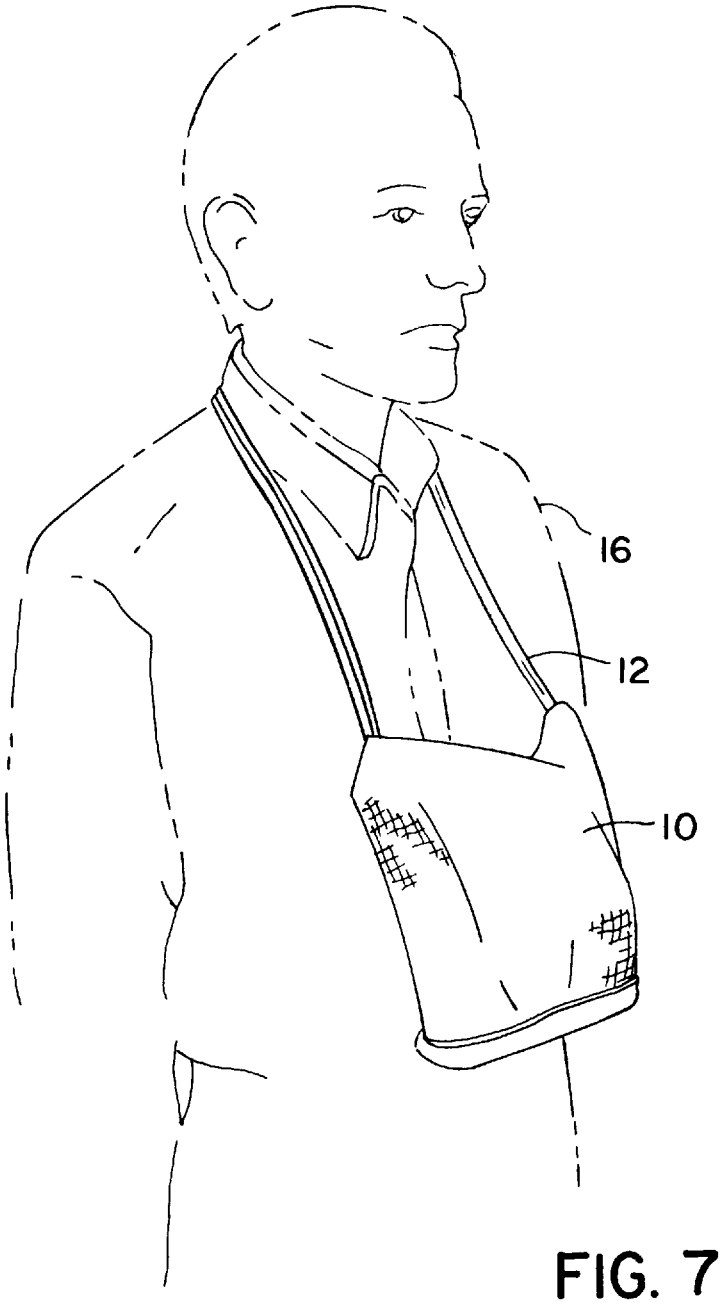
FIG. 7 is a view of the case returned around the user's neck with the binoculars stored therein.

Turning now to the Figures, FIG. 1 illustrates a flexible, convertible case, designated generally by the reference numeral 10, secured to a strap 12 for supporting an instrument, such as a pair of binoculars 14. In the configuration illustrated in FIG. 1, case 10 is folded and stored to permit access to instrument 14. In this configuration, case 10 may be conveniently placed behind the neck of a user 16. As described in more detail below, case 10 is preferably made of a soft, flexible fabric or composite material, such as rubber, neoprene, rubber bonded to fabric, or the like, and thus forms a comfortable pad behind the user's neck when in the folded and stored configuration shown in FIG. 1. Case 10 is designed to be slidingly received on strap 12. In the preferred embodiment, case 10 is fed onto strap 12 as described below, and ends 18 of strap 12 are fastened to instrument 14, such as via a pair of rings 20 provided thereon.

As shown in FIG. 2, case 10 defines a pouch 22 which, when in its folded and stored position, rests along a central portion 24 of strap 12. Pouch 22 is preferably formed of a single ply of flexible sheet material folded along an upper fold line 26. A lower fold 28 is conveniently provided to reduce the exposed size of pouch 22 in the stored position. When such a lower fold 28 is provided, pouch 22 is divided into an upper portion 30, presenting an exposed face panel 32, and a lower portion 34, folded up into upper portion 30. Side edges 36 of pouch 22 preferably converge toward lower fold 28. The sheet material forming pouch 22 is joined along side edges 36 to close pouch 22 on either side. At locations adjacent to upper fold 26, side edges 36 are not joined so as to form side apertures 38 through which strap 12 is slidingly received.

While several pieces and plies of flexible sheet material may be used to construct case 10, as best illustrated in FIG. 3, case 10 is preferably formed from a single piece of material cut in a single ply 40. The ply 40 of material is creased along upper fold 26, and side edges 36 are joined along a seam 42, such as by stitching, sonic welding, gluing or any other suitable fixation technique. In addition, a lower fold 28 is preferably formed by stitching or otherwise joining sides of ply 40 along a line generally parallel to upper fold 26, generally at approximately the mid point between fold 26 and the lower end of pouch 22. This structure effectively biases ply 40 between upper and lower portions 30 and 34, tending to fold lower portion up into upper portion 34 and thereby facilitating storage of pouch 22.

Ply 40 is not joined along a lower edge to create an opening 44 (shown folded into upper portion 30 in FIG. 3) through which instrument 14 may be inserted and removed as described below. Positive closure elements 46 and 48 are provided on either side of opening 44 to allow pouch 22 to be closed both in the folded and stored configuration, and in the opened protective configuration described below (see FIG. 7). As illustrated in the Figures, a convenient closure system consists of hook and loop fastener elements sewn to ply 40 adjacent to opening 44. Alternative closure elements include snaps, buttons, draw strings, zippers and the like. As described below, because pouch 22 is folded in the stored configuration, then unfolded and inverted into the opened configuration, closure elements 46 and 48 are placed in mutually facing relation in both configurations, permitting pouch 22 to be easily maintained closed in either configuration.

FIGS. 4, 5 and 6 illustrate how case 10 is manipulated from the stored position of FIG. 2 to the protective configuration for covering instrument 14. As mentioned above, case 10 is first installed on strap 12 by passing strap 12 through side apertures 38, then connecting strap 12 to instrument 14 in a conventional manner. As shown in FIG. 4, from the stored position of FIG. 2, the lower portion 34 of pouch 22 is first removed from the upper portion 30 by disconnecting closure elements 46 and 48 from one another and extracting lower portion 34. The user then reaches within pouch 22 to grasp central portion 24 of strap 12 and draws central portion 24 out of pouch 22 as shown in FIG. 5. This action slides case 10 along strap 12, bringing upper fold 26 adjacent to instrument 14. Pouch 22 is then inverted as indicated by arrows A in FIG. 5, to wrap case 10 progressively around instrument 14. Finally, as shown in FIG. 6, case 10 is brought completely around instrument 14, with upper fold 26 (now reversed from its initial orientation) adjacent to instrument 14. In this position, closure elements 46, 48 are again in mutually facing relation and may be joined to secure case 10 over instrument 14. Once placed in the protective configuration of FIG. 6, case 10 may be conveniently suspended from the user's neck as shown in FIG. 7.

It should be noted that the preferred structure described above offers a number of advantages over heretofore known cases and covers. For example, because case 10 is slidingly secured to strap 12, it may be easily displaced away from instrument 14 when the user desires to access instrument 14 for long periods, removing the inconvenience of having the case dangle in close proximity to instrument 14 when in use. Moreover, case 10 can be thus displaced without removal from strap 12, reducing the risk of loss. In addition, exposed panels of pouch 22 provide an excellent platform for advertising messages, logos, corporate identifiers and the like. In particular, because pouch 22 is folded into a reduced width in the stored configuration, face panel 32 (see FIG. 2) provides a convenient location for such indicia.

What is claimed is:

1. A case for an instrument coupled to a support strap having first and second ends, and a central region intermediate the first and second ends, each end of the support strap being secured to the instrument whereby the instrument may be transported and suspended on the strap, the case comprising:

a first panel having a first upper and lower edges and first left and right side edges;

a second panel having second upper and lower edges and second left and right side edges;

the first upper edge being joined to the second upper edge and the first lower edge being partially joined to the second lower edge to form a pouch having an opening for receiving the instrument, the first left side edge being partially joined to the second left side edge and the first right side edge being partially joined to the second right side edge to form right and left apertures, the left and right apertures being configured to receive the strap, the case being slidable along the strap to permit the first and second upper edges to be moved from a position proximate the first and second ends of the strap to a position adjacent and substantially parallel to a portion of the central region of the strap.

2. The case of claim 1, further comprising first and second cooperating closure elements, the first closure element being disposed on the first panel adjacent to the opening and the second closure element being disposed on the second panel adjacent to the opening, the first and second closure elements cooperating to positively close the opening in a first operational configuration of the case and thereby to maintain the case over the instrument when placed therein.

3. The case of claim 2, wherein the first and second closure elements comprise a hook and loop fastener system.

4. The case of claim 2, wherein the first and second closure elements are disposed in mutually facing relation with respect to one another in a second operational configuration of the case, the pouch being inverted in the second operational configuration of the case.

5. The case of claim 4, wherein the first and second panels include a biasing fold generally parallel to the first and second upper edges, the biasing fold urging the pouch into a folded position in the second operational configuration of the case.

6. The case of claim 1, wherein the first and second panels comprise a single piece of flexible material.

7. The case of claim 1, wherein the first and second panels comprise two separate pieces of flexible material joined to one another by stitching.

8. The case of claim 1, wherein the first and second panels comprise a resilient, flexible material.

9. An invertible cover for an object supported around a user's neck via a suspension strap, the cover comprising:

a flexible pouch having a central opening for receiving the object and first and second side apertures permitting passage of the strap therethrough, whereby the pouch may be slidingly received on the strap, the pouch being configured for use in a first operational configuration wherein the opening is positioned adjacent to the object, and a second operational configuration wherein the pouch is inverted from the first operational configuration and slidably positioned along a central region of the strap; and positive closure means disposed on the pouch adjacent to the opening, the positive closure means being operative in both the first and second operational configurations of the case to attach portions of the pouch to one another for closure of the opening, wherein in the second operational configuration a portion of the pouch is located along a portion of the central region of the strap forming a neck pad interposed between the strap and the user's neck.

10. The cover of claim 9, wherein the pouch includes a biasing fold extending generally parallel to the opening, the biasing fold urging the pouch into a folded position in the second operational configuration of the case to align the closure means in mutually facing relation.

11. The cover of claim 9, wherein the pouch comprises a single piece of fabric folded along an edge opposite to the opening to form first and second panels.

12. The cover of claim 11, wherein the pouch includes first and second side regions extending between the opening and the first and second side apertures, respectively, the first and second panels being partially joined in the first and second side regions to define the opening and the first and second side apertures.

13. The cover of claim 9, wherein the pouch comprises a resilient composite material.

14. A protective support and cover system for an instrument, the system comprising:

a support strap having first and second ends and a central region extending therebetween, the first and second ends being configured for coupling to the instrument;

a flexible pouch having a central opening for receiving the instrument and first and second side apertures, the strap extending through the first and second side apertures whereby the pouch is slidingly received on the strap, the pouch being configured for use in a first operational configuration wherein the opening is positioned adjacent to the instrument, and a second operational configuration wherein the pouch is inverted from the first operational configuration and slidably positioned along the central region of the strap; and the pouch including a side wall having a biasing fold formed therein by joining a portion of the side wall to itself, the biasing fold urging the pouch into a folded position in the second operational configuration of the case.

15. The cover of claim 14, wherein the biasing fold extends generally parallel to the opening, the biasing fold urging the pouch into a folded position in the second operational configuration of the case to align the closure means in mutually facing relation.

16. The cover of claim 14, wherein the pouch comprises a single piece of fabric folded along an edge opposite to the opening to form first and second panels.

17. The cover of claim 14, wherein the pouch includes first and second side regions extending between the opening and the first and second side apertures, respectively, the first and second panels being partially joined in the first and second side regions to define the opening and the first and second side apertures.

18. The cover of claim 14, wherein the pouch comprises a resilient composite material and wherein a portion of the pouch opposite to the opening forms a neck pad interposed between the strap and the user's neck in the second operational configuration.

* * * * *